US008660279B2

(12) United States Patent
Varla

(10) Patent No.: US 8,660,279 B2
(45) Date of Patent: Feb. 25, 2014

(54) NESTED COMPOUND LOUDSPEAKER DRIVE UNIT

(75) Inventors: Ari Olavi Varla, Iisalmi (FI); Anni Tuulia Kolisoja, legal representative, Helsinki (FI); Terhi Ina Aurora Varla, legal representative, Iisalmi (FI); Arno Mikael Varla, legal representative, Iisalmi (FI)

(73) Assignee: Genelec Oy, Iisalmi (FI)

( * ) Notice: Subject to any disclaimer, the term of this patent is extended or adjusted under 35 U.S.C. 154(b) by 657 days.

(21) Appl. No.: 12/921,363

(22) PCT Filed: Mar. 5, 2008

(86) PCT No.: PCT/EP2008/052665

§ 371 (c)(1),
(2), (4) Date: Oct. 26, 2010

(87) PCT Pub. No.: WO2009/109228

PCT Pub. Date: Sep. 11, 2009

(65) Prior Publication Data

US 2013/0142379 A1 Jun. 6, 2013

(51) Int. Cl.
*H04R 25/00* (2006.01)
*H04R 1/00* (2006.01)

(52) U.S. Cl.
USPC ..... 381/182; 381/423

(58) Field of Classification Search
USPC ..... 381/182, 184, 185, 186, 386, 396, 401, 381/402; 181/141, 144, 154, 163, 199
See application file for complete search history.

(56) References Cited

U.S. PATENT DOCUMENTS

| | | | | |
|---|---|---|---|---|
| 5,548,657 | A * | 8/1996 | Fincham | 381/182 |
| 5,604,815 | A | 2/1997 | Paddock | |
| 5,991,425 | A * | 11/1999 | Anagnos | 381/423 |
| 6,356,640 | B1 | 3/2002 | Lin | |
| 6,493,452 | B1 | 12/2002 | Koizumi et al. | |
| 6,745,867 | B2 | 6/2004 | Anthony et al. | |

FOREIGN PATENT DOCUMENTS

| | | | |
|---|---|---|---|
| EP | 1 278 397 | A2 | 1/2003 |
| JP | 4-326296 | A | 11/1992 |
| JP | 6-165291 | A | 6/1994 |
| JP | 6165291 | A * | 6/1994 |
| JP | 06165291 | A * | 6/1994 |
| JP | 2003-61187 | A | 2/2003 |
| JP | 2003-299191 | A | 10/2003 |

* cited by examiner

*Primary Examiner* — Curtis Kuntz
*Assistant Examiner* — Sunita Joshi
(74) *Attorney, Agent, or Firm* — Birch, Stewart, Kolasch & Birch, LLP

(57) ABSTRACT

A loudspeaker driver (22) also suitable for compound applications comprising a rigid speaker frame (11, 13, 15, 19, 8) to which is attached a permanent magnet (13) with which a voice coil winding (9) is adapted to interact through electromagnetic force. The voice coil winding (9) is adapted to deliver axial motion to a diaphragm assembly (21), which includes an elastic outer section (2), whose outer rim (5) is attached to the outer part of the speaker frame (11). The diaphragm assembly (21) comprises an essentially rigid primary vibrating diaphragm (4) attached between the elastic outer section (2) and an elastic inner section (3), whose inner rim (10) is attached to the inner part of said speaker frame (8). Said voice coil winding (9) is fixed to the primary vibrating diaphragm (4) through said voice coil former (6), which is adapted to move said diaphragm assembly (21).

16 Claims, 5 Drawing Sheets

NESTED COMPOUND LOUDSPEAKER DRIVE UNIT

The present invention relates to loudspeakers. More specifically, the present invention relates to a new type of drive unit, which according to one preferred embodiment, may be a nested compound drive unit, which is especially suitable for midrange and high frequency sound reproduction applications.

Compound loudspeakers conventionally comprise at least two drive units, which provide reproduction of suitable bands of low and high frequencies. Traditionally the low and the high frequency drive units have been separate entities, but when pursuing high fidelity without response and directivity irregularities, the drive units are positioned somewhat concentrically. Thus, improved compound loudspeaker drive units are typically low/mid frequency units integrated with a high frequency drive unit wherein each of the high frequency units are separately attached either in front of or close to the low frequency voice coil of the system. An example of the latter may be found in publication U.S. Pat. No. 5,548,657 (Fincham) where the high frequency driver has been nested inside the low frequency voice coil and separated from said coil by a sufficient gap to allow contact-free axial motion of the said voice coil.

Other prior art examples of compound or coaxial drive units can be found in publications:

U.S. Pat. No. 6,493,452
U.S. Pat. No. 5,604,815
U.S. Pat. No. 6,356,640
U.S. Pat. No. 6,745,867

The prior art designs typically suffer from acoustical mismatch between the high frequency diaphragm and its close bounding acoustical surfaces, primarily the low frequency cone including its surroundings. If the high frequency diaphragm is elevated forward from the low frequency cone neck (publications U.S. Pat. Nos. 6,493,452 and 6,356,640), a part of the radiation of the high frequency diaphragm is directed rearwards towards the low frequency cone and is further reflected back forward from the cone with the result of interfering with the direct radiation from the high frequency diaphragm. This will degrade the high frequency radiation characteristics of the high frequency diaphragm by causing a comb-filter effect into the acoustic frequency response of the system.

Referring to the application described in publication U.S. Pat. No. 5,548,657, another type of acoustical mismatch occurs in between the cone (21) and the high frequency diaphragm (27) where a circular gap has been left between the cone and the high frequency driver annular baffle (44) to allow axial movement of the low frequency cone. This gap forms an acoustical coupling mismatch for the high frequency diaphragm and due to its circular shape and the radial nature of the radiated wave front of the said diaphragm, a significant diffraction typically occurs on the frontal radiation axis of the system. The frequency range of such diffraction is typically between 2 kHz and 20 kHz, depending upon the used driver geometry. The same phenomena causes also the outer flexible surround (22) to generate an acoustical mismatch resulting in radial diffraction in the same manner as the voice coil neck, but at different frequencies. An attempt has been made in publication U.S. Pat. No. 6,745,867 to avoid this problem by smoothening the surround geometry.

Generally speaking the known attempts to provide a compound loudspeaker suffer from complex mechanical structures and diffraction problems caused by geometrical discontinuity of the diaphragm. The diffraction problems typically result in impaired frequency response and directivity control.

It is an object of the present invention to provide a low/mid frequency drive unit, which may be used in compound loudspeaker applications and which will overcome at least some of the above-mentioned disadvantages. Therefore a new type of a midrange driver construction principle is presented, which provides for a principle of acoustical coupling that has been realized by a dual radial suspension diaphragm utilizing a push-pull linearization principle of axial motion in order to reduce the harmonic distortion of the said midrange driver.

Furthermore, it is an object of the present invention to provide a principle where the acoustical coupling of the high frequency diaphragm to air is as continuous as possible i.e. the immediate forward bounding geometry of the said diaphragm is free from abrupt discontinuities, especially those of radial nature, that would cause secondary acoustical radiation and would thus result in acoustical interference between the direct radiation of the said diaphragm and the said secondary radiation. These will result in improved on- and off-axis frequency responses of the high frequency driver of the system.

The invention is based on a new type of loudspeaker driver comprising an essentially rigid chassis and essentially flexible suspension elements that are moved by an essentially rigid primary vibrating diaphragm.

More specifically, the apparatus according to the invention is characterized by what is stated in the independent claim.

Considerable advantages are gained with the aid of the invention. Compared to prior art designs, the present invention provides reduced diffraction products in sound radiation which results in smoother frequency response and better directivity control. Due to improved suspension linearity, the present invention benefits from reduced acoustic harmonic distortion. Also, because the invention has a rather simple mechanical construction, already available components and manufacturing technology can be applied enabling economical production of the invention.

Some embodiments of the present invention shall now be described in detail with reference to the accompanying drawings, in which.

In this context the term rigid means structures that are not supposed to significantly vibrate as a result of the applied electromechanical force generated by any of the voice coils in the system and the term elastic means structures that flex, compress or expand as a result of the applied electromechanical force generated by any of the voice coils in the system. Furthermore, the term forward direction means the direction to which sound waves primarily radiate from the speaker, i.e. the direction to which the diaphragm movement approaches the assumed sound receiver. Conversely, the term rearward direction means the opposite of forward direction. Respectively, the terms front and rear represent the sides of the speaker that are in the direction of forward or rearward directions. The term voice coil former is used to refer to any sort of structure capable of mechanically connecting a voice coil and a vibrating diaphragm, which means that it may also be a direct bond between said two components.

Figure 1:
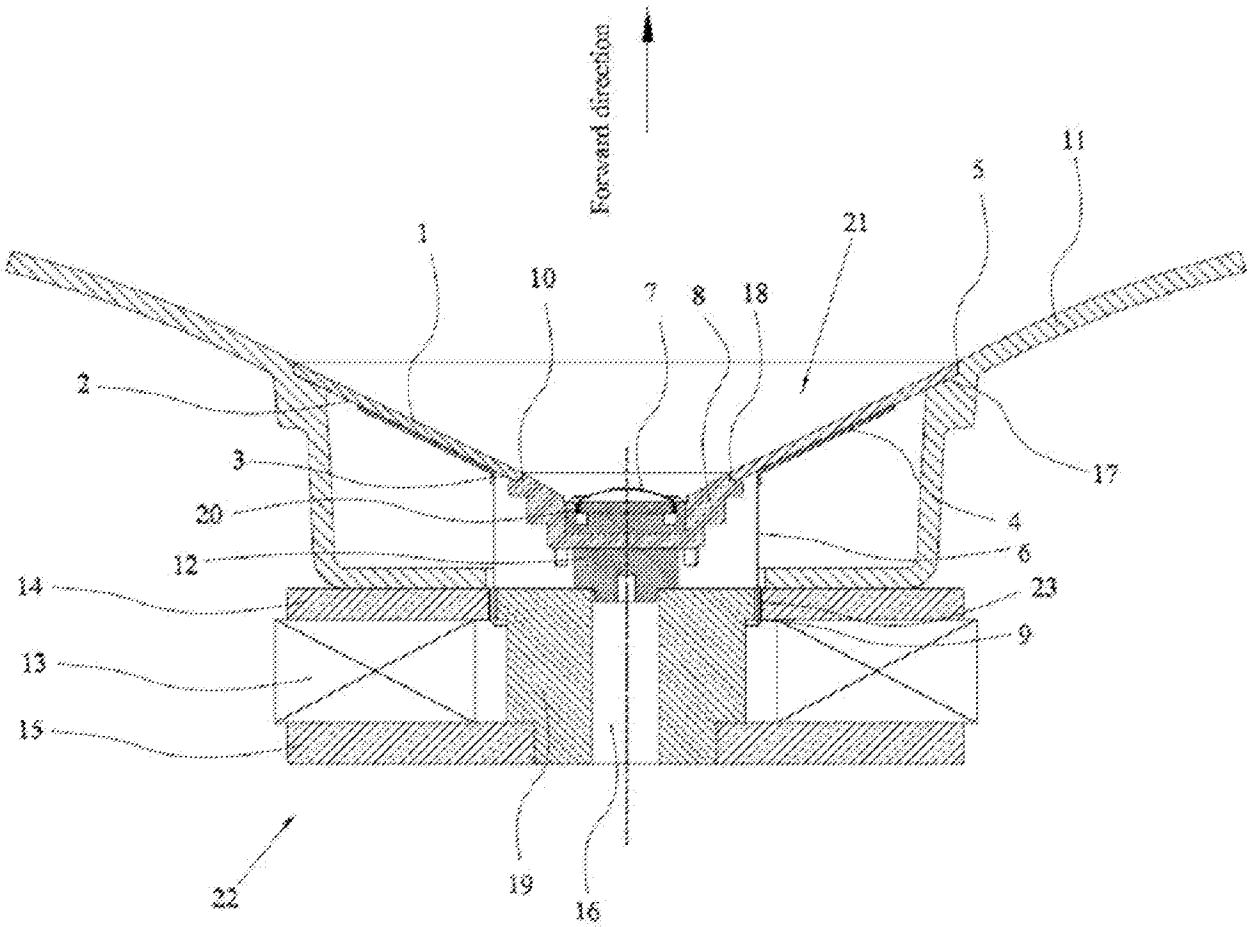
FIG. 1 shows a cross-section view of a driver with a continuous diaphragm in a nested coaxial application.

As illustrated in FIG. 1, according to one embodiment of the present invention the loudspeaker is formed by a rigid frame comprising the following components: an outer rigid structure 11 and an inner rigid structure 8 as well as supporting structures: a (high frequency driver) mounting adapter 12, a magnetic pole piece 19, a magnetic circuit yoke plate 14 and a magnetic circuit back plate 15, which shall be discussed further on. The first-mentioned part of the loudspeaker structure connects to or forms at least a part of the enclosure. It also houses the inner rigid structure 8 and the sound generating i.e. vibrating parts, which are located either between the outer 11 and inner 8 rigid structures or within the inner rigid structure 8. From here on, the outer rigid structure 11 shall also be referred to as the assembly chassis 11 and the inner rigid structure 8 as the high frequency driver chassis 8.

In more detail the driver assembly 22 has a nested compound structure, which is built on the speaker assembly chassis 11. In other words the speaker assembly chassis 11 accommodates a midrange driver and a high frequency driver, which is built within the midrange driver voice coil former 6, which is presented in FIGS. 1 and 2. They are cross-section views and therefore feature vertical dotted lines to represent imaginary axes of revolution. The axis of revolution of the midrange driver voice coil former 6 does not necessarily have to equal with the axis of the high frequency driver voice coil 20, although this is the most likely practical implementation. The high frequency voice coil 20 is by nature quite small and may have a suitable diameter between 10 and 55 mm.

The speaker assembly chassis 11 is connected to a magnetic circuit yoke plate 14 from its rear flange. The magnetic circuit yoke plate 14 is further fixed to a magnetic circuit back plate 15. Between the two, there is a permanent magnet 13, which provides a continuous magnetic field into the magnetic air gap 23. The permanent magnet 13 is, according to one embodiment, a ring made of a ferrite material (e.g. "Ferroxdure 300"), with an outer diameter of 134 mm and height of 20 mm. The flux density of the magnetic air gap 23 is preferably 1.4 T (i.e. B=1.4 T), which is obtained by a height of 6 mm and width of 1.35 mm.

The plates 14 and 15, a centre pole piece 19 and the permanent magnet 13 create a magnetic circuit structure in relation to which the voice coils of the drivers move. The magnetic circuit centre pole piece 19 is also attached to a (high frequency) mounting adapter 12, which connects the assembly chassis 11 to the high frequency driver chassis 8. The high frequency driver chassis 8 may be used to host a high frequency driver diaphragm 7 and its magnet and the high frequency driver voice coil winding 20 as shown in FIG. 1. Generally considering, the high frequency driver chassis 8 is the mounting member to the diaphragm assembly 21. The high frequency driver chassis 8 may suitably have a forward opening angle between 30 and 80 degrees measured sectionally between the voice coil 20 motion axis and the tangent of chassis 8 in direction of its radius. The voice coil assembly—comprising the voice coil winding 9 and the voice coil former 6—acts by current-induced electromagnetic force provided by the permanent magnet 13 and the voice coil winding 9, whose suitable diameter may be between 15 and 110 mm.

The diaphragm assembly 21 is attached from its outer seam 5 to the speaker assembly chassis 11 and from its inner seam 10 to the high frequency driver chassis 8. The diaphragm assembly 21 furthermore has an essentially rigid primary vibrating diaphragm 4 attached to its surface. The attachment is typically manufactured by gluing, thermally laminating, welding or molding the said diaphragms 1 and 4 into one integrated part, where the primary vibrating diaphragm 4 can be on either front or rear side of said elastic diaphragm 1 or it can be entirely molded within said diaphragm 1. The elastic diaphragm 1 itself, is preferably made of elastic foamed rubber, more specifically EPDM-NR-SBR closed shell rubber, whose suitable thickness may be between 0.1 and 6 mm, preferably approximately 2 mm, and whose hardness is between 20 and 50 shore and diameter of approximately 120 mm The diaphragm 1 and the primary vibrating diaphragm 4 may be bonded using neoprene adhesive. In any event, it is pertinent that there is a solid attachment to the primary vibrating diaphragm 4, whose suitable diameter may be between 35 and 250 mm and whose suitable thickness may be between 0.05 and 5 mm. More specifically, the primary vibrating diaphragm 4 is preferably made of 0.2 mm thick deep-drawn aluminium sheet, whose diameter is 100 mm. Furthermore, the primary vibrating diaphragm 4 may have a forward opening angle between 30 and 80 degrees measured sectionally between the voice coil 9 motion axis and the tangent of the diaphragm 1 in direction of its radius. More specifically, the angle is suitably approximately 63 degrees.

A gap between the primary vibrating diaphragm 4 and the speaker assembly chassis 11 has been left for the elastic diaphragm 1 to operate as a flexible suspension element allowing axial movement of the primary vibrating diaphragm 4. This gap is called the outer radial section 2. The outer radial section 2 is fully covered by the elastic diaphragm 1. A gap between the primary vibrating diaphragm 4 and the high frequency driver chassis 8 has been left for the elastic diaphragm 1 to operate as a flexible suspension element allowing axial movement of the primary vibrating diaphragm 4. This gap is called the inner radial section 3. The inner radial section 3 is fully covered by the elastic diaphragm 1. A flexible diaphragm joint to the speaker assembly chassis 11, i.e. the interface between the diaphragm assembly outer seam 5 and the assembly chassis 11, has been made smooth and continuous in order to minimize acoustical diffraction and to improve the acoustical coupling of the high frequency driver diaphragm 7 specifically in coaxial applications. Generally speaking, a suitable smoothness i.e. continuous radial profile may be defined as the axial offset between the diaphragm 1 and chassis 11 being less than 2 mm measured across the seam 5 and the axial offset between the diaphragm 1 and high frequency chassis 8 being less than 2 mm measured across the seam 18.

The primary vibrating diaphragm 4 is connected to the voice coil former 6, which has in its other end a voice coil winding 9. The voice coil former 6 may be made of 0.1 mm thick rolled aluminium sheet, which has a diameter of 51 mm and length of 30 mm. Respectively, the voice coil winding 9 may be made of 0.3 mm thick copper-clad aluminium wire, which has a winding length of 7 mm in two layers. The voice coil winding 9 acts together with the permanent magnet 13 by current-induced electromagnetic force. The axial movement of the voice coil winding 9 is transferred to the primary vibrating diaphragm 4 by the voice coil former 6. Since the primary vibrating diaphragm 4 is connected to the voice coil winding 9 through the voice coil former 6 and because the diaphragm assembly 21 is connected to the high frequency driver chassis 8, there is typically no need for a conventional spider-type axial suspension.

Figure 4:
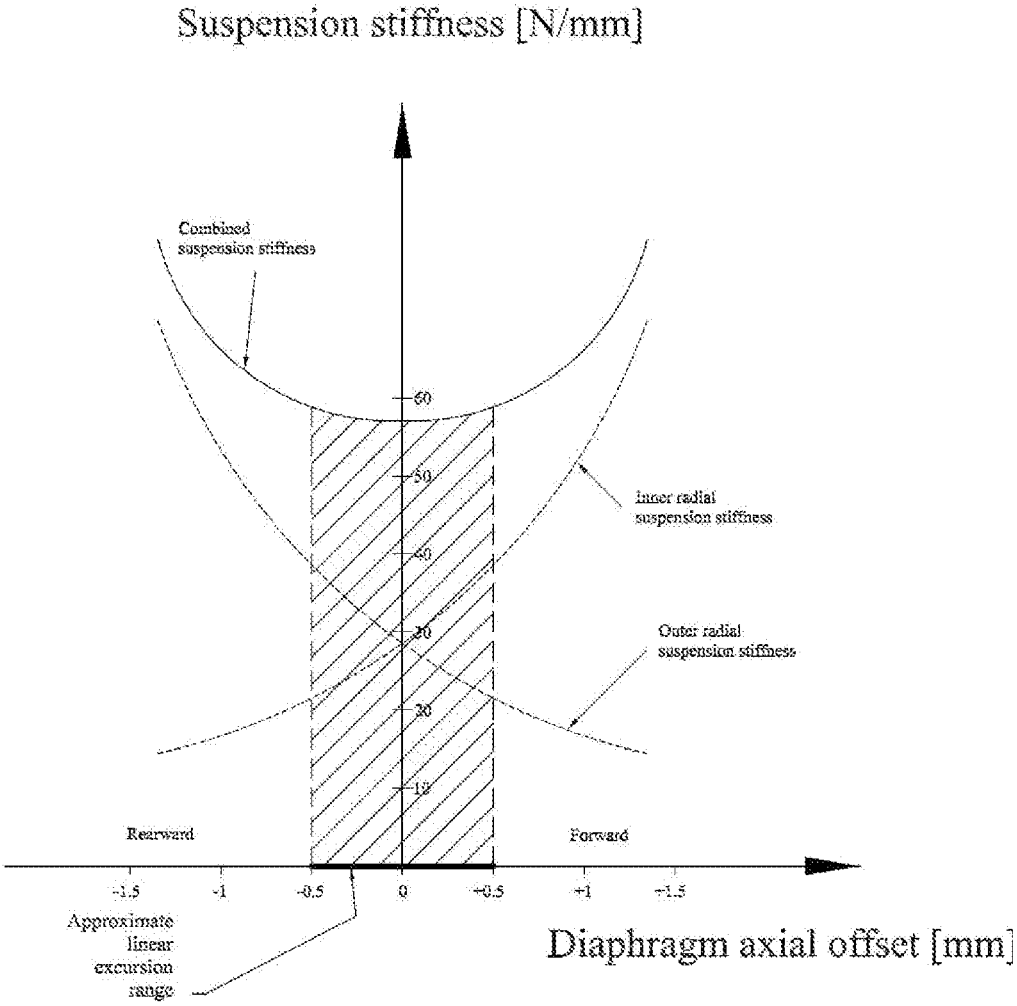
FIG. 4 shows a plot depicting the relation between the axial offset and suspension stiffness of the diaphragm.

As the primary vibrating diaphragm 4 moves axially, the motion is transferred to the diaphragm assembly 21. This axial motion causes the outer radial section 2 and inner radial section 3 to conform to the movement by axial and radial deformation. The relation between the stiffness of the radial sections and axial offset of the diaphragm assembly 21 is shown in FIG. 4. The geometry of said deformation is of symmetrical nature between the outer and inner flexible radial sections during positive and negative (i.e. forward and rearward) excursions. The combination of the outer radial section 2, primary vibrating diaphragm 4 and inner radial section 3 could also be presented as an equivalent spring—rigid member—spring structure, where the two springs each have a non-linear stiffness-to-excursion characteristic curve, and these two curves being fairly symmetrical to each other in relation to excursion. This characteristic results in a linearized combined stiffness of the axial suspension of the diaphragm assembly 21. This, in turn, will result in a significantly lower even-harmonic acoustical distortion generation of the drive unit compared to one having only a single flexible radial section.

Figure 2:
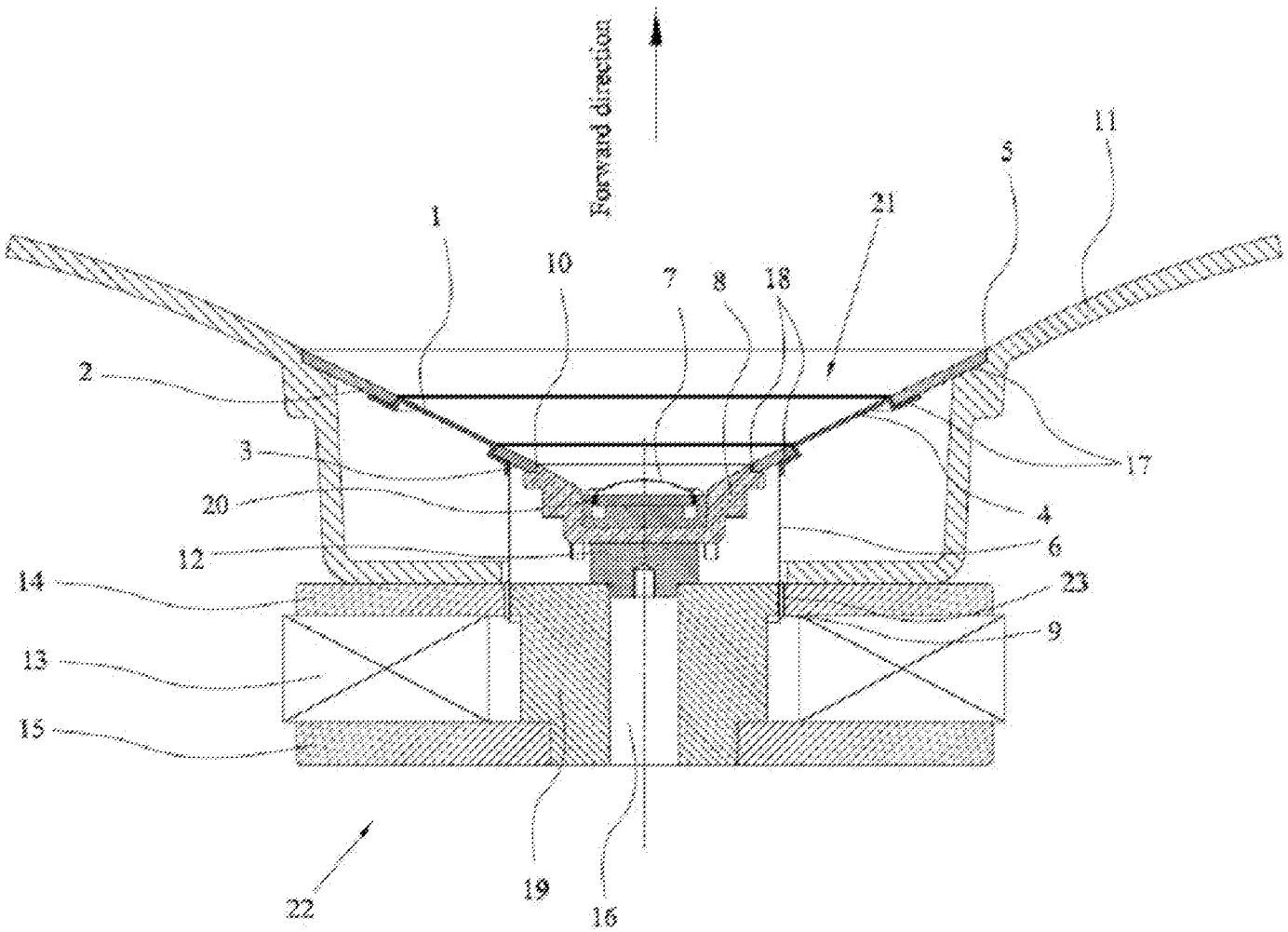
FIG. 2 shows a cross-section view of a driver with a parted diaphragm in a nested coaxial application.
Figure 5:
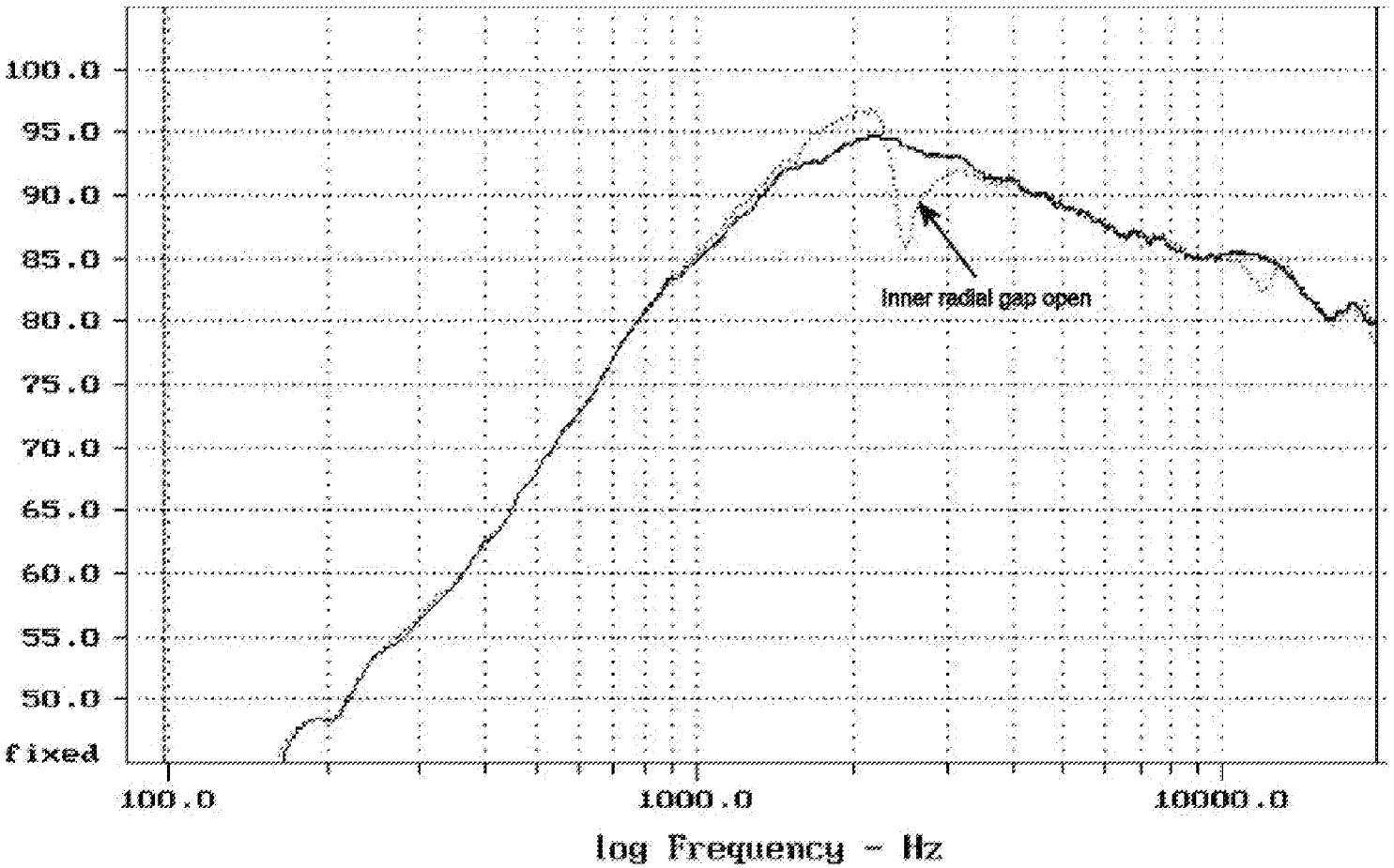
FIG. 5 shows an example of the effect of an inner radial gap of 1 mm width on the frequency response of a 25 mm nested dome tweeter mounted within a 40 mm voice coil former.

As illustrated in FIG. 2, the primary vibrating diaphragm 4 may be attached to the diaphragm assembly 21 so that it forms a radial section between the outer 2 and inner 3 radial sections. This way there is no covering flexible diaphragm 1 over the primary vibrating diaphragm 4 as is the case according to the embodiment presented in FIG. 1. On the contrary, viewing the driver frontally, the diaphragm assembly 21 is divided into three distinctive coaxial rings where the primary vibrating diaphragm 4 forms a middle radial section producing the axial motion. The primary vibrating diaphragm 4 is attached from its extending attachment flanges to the inner radial section 3 and outer radial section 2. The attachment is typically manufactured by gluing, thermally laminating, welding or molding. The inner radial section 3 is attached to the high frequency driver chassis 8 from its inner edge 10 similarly as in the embodiment described with reference to FIG. 1, which is also the case with the attachment of the outer radial section 2 to the assembly chassis 11. The attachment of the inner radial section 3 to the high frequency driver chassis 8 is a critical one, because it should create an interface that is as smooth as possible to minimize acoustical diffraction and to improve the acoustical coupling of the high frequency driver diaphragm 7 specifically in coaxial applications. This is also the case in the attachment between the diaphragm assembly outer seam 5 and the assembly chassis 11 as described above. If there were to be a gap between the inner radial section 3 and the high frequency chassis 8, it would result in impaired frequency response as shown in FIG. 5. With a construction according to the present invention, the high frequency band is typically between 3 kHz and 20 kHz with an average sensitivity of approximately 88 dB/W/1 m. Respectively, the midrange frequency band is typically between 450 Hz and 3 kHz with an average sensitivity of 94 dB/W/1 m.

The primary vibrating diaphragm 4 is further attached to a similar voice coil winding 9 as in the embodiment described with reference to FIG. 1. A voice coil winding 9 is attached to the inner extending attachment flange of the primary vibrating diaphragm 4 via a voice coil former 6. As the primary vibrating diaphragm 4 moves axially, the outer 2 and inner 3 radial sections yield by deforming as in the embodiment presented in FIG. 1. The deformation conforms to the model presented in FIG. 4.

Figure 3:
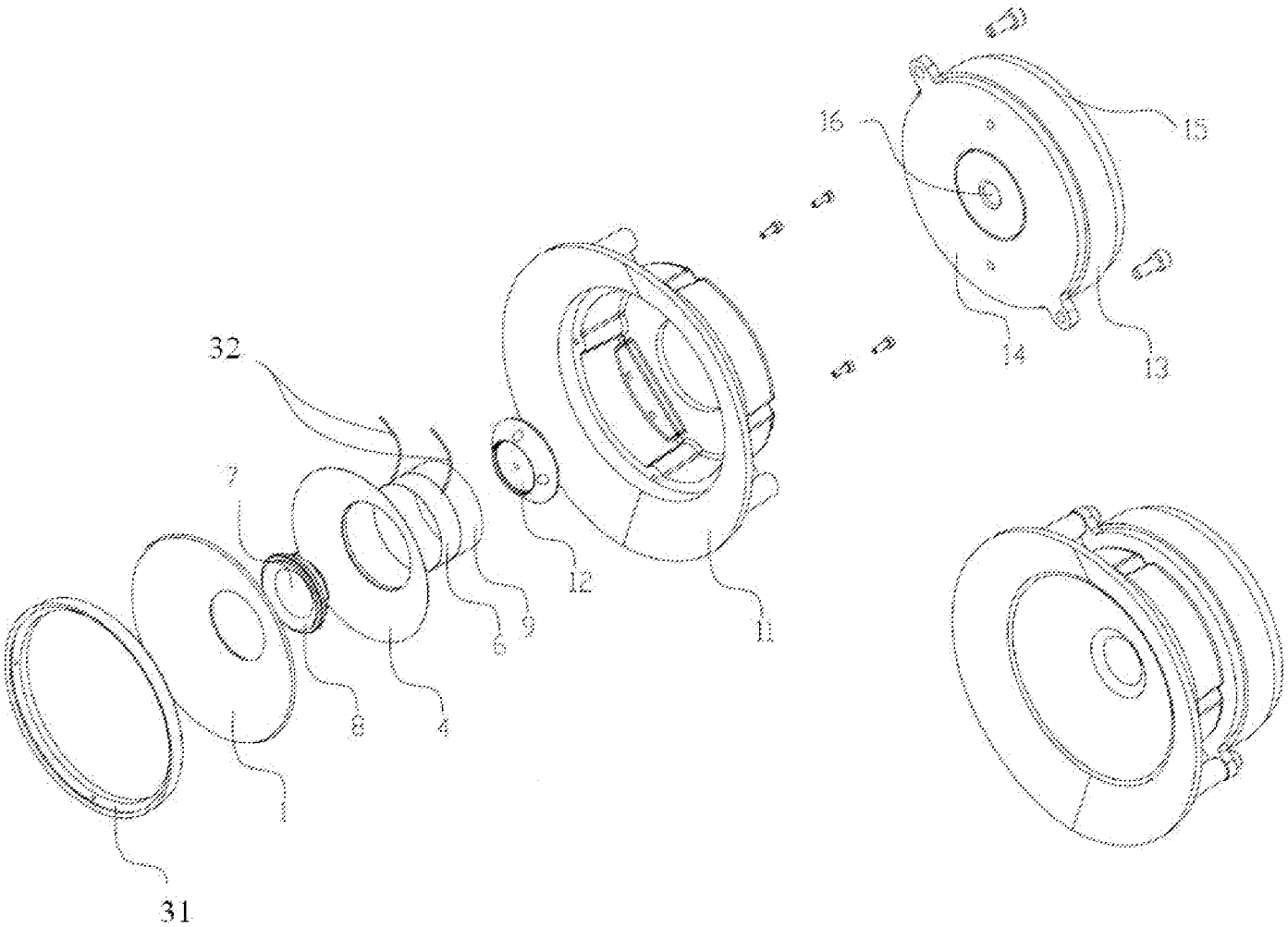
FIG. 3 shows an exploded view of a coaxial compound driver assembly.

FIG. 3 shows an explosion view and an assembly view of the embodiment presented in FIG. 1 and it features a couple of illustrative and essential details. An outer mounting ring 31 has a mounting surface (outer mounting surface 17 in FIGS. 1 and 2), which is tilted inward and which is precisely manufactured to accommodate the outer seam 5 of the diaphragm assembly 21. Also, the figure shows two voice coil flexible wires 32 that reach out from the voice coil winding 9. A power amplifier or such is connected to the voice coil winding 9 through possible passive cross-over filters (not shown) via flexible wires 32. The filters can be alternatively substituted by active electronic filters in which case they are located prior to the power amplifiers each driving their specific voice coils 9, 20 with signal bandwidths and possible equalizations complementing the said drivers.

The above-described embodiments represent only a couple of advantageous alternatives. There are naturally other optional ways of implementing the present invention defined in the claims. For example, the primary vibrating diaphragm 4 may also be cohesive with outer 2 and inner 3 radial sections, so that the parts are of uniform structure, which has rigid and flexible sectional properties. Such properties could in theory be realized by producing a diaphragm with uniform material having diverse cross-sectional thickness or solidity.

The investment claimed is:

1. A loudspeaker driver comprising:

a rigid speaker frame;

a permanent magnet attached to the rigid speaker frame;

a voice coil winding adapted to interact through electromagnetic force with the permanent magnet;

a diaphragm assembly to which the voice coil winding is adapted to deliver axial motion, wherein a front side of the diaphragm assembly forms the primary direction for sound reproduction, a rear side of the diaphragm assembly is for connection to said voice coil winding, and the diaphragm assembly includes an elastic outer section whose outer rim is attached to the outer part of the speaker frame;

wherein said diaphragm assembly comprises a rigid primary vibrating diaphragm attached between the elastic outer section and an elastic inner section, whose inner rim is attached to the inner part of said speaker frame; and the front side of said diaphragm assembly and said inner rim have essentially a continuous radial profile, whereby said diaphragm assembly and the coupling thereof to said inner part of the speaker frame incur no abrupt discontinuities.

2. A loudspeaker driver according to claim 1, wherein said primary vibrating diaphragm is attached onto said diaphragm assembly so that said primary vibrating diaphragm is covered by said elastic diaphragm when viewing from the forward side of the driver.

3. A loudspeaker driver according to claim 1, wherein said primary vibrating diaphragm is attached onto said diaphragm assembly so that said primary vibrating diaphragm is exposed when viewing from the forward side of the driver.

4. A loudspeaker driver according to claim 1, wherein the loudspeaker driver is a nested driver comprising a high frequency diaphragm together with said diaphragm assembly.

5. A loudspeaker driver according to claim 4, wherein the high frequency diaphragm is housed in said inner rigid part of said speaker frame.

6. A loudspeaker driver according to claim 1, wherein said diaphragm assembly has an essentially constant forward flare angle.

7. A loudspeaker driver according to claim 1, wherein said diaphragm assembly has a progressively increasing forward flare angle.

8. A loudspeaker driver according to claim 1, wherein the forward opening flare angle is between 30 and 80 degrees.

9. A loudspeaker driver according to claim 6, wherein said inner rigid part of said speaker frame shares the forward flare angle with said diaphragm assembly.

10. A loudspeaker driver according to claim 9, wherein said inner rigid part of said speaker frame has a forward opening angle between 30 and 80 degrees measured sectionally between the voice coil motion axis and the tangent of chassis in the direction of its radius.

11. A loudspeaker driver according to claim 1, wherein the axial offset between said diaphragm assembly and said assembly chassis is less than 2 mm measured across the outer rim.

12. A loudspeaker driver according to claim 1, wherein the axial offset between said diaphragm assembly and said inner rigid part of said speaker frame is less than 2 mm measured across the seam.

13. A loudspeaker driver according to claim 1, wherein the voice coil of said high frequency diaphragm has a diameter between 10 and 55 mm.

14. A loudspeaker driver according to claim 1, wherein said voice coil winding has a diameter between 15 and 110 mm.

15. A loudspeaker driver according to claim 1, wherein said primary vibrating diaphragm has a diameter between 35 and 250 mm.

16. A loudspeaker driver according to claim 14, wherein said primary vibrating diaphragm has a diameter of 100 mm.

* * * * *